US006811302B2

(12) United States Patent
Fleischli et al.

(10) Patent No.: US 6,811,302 B2
(45) Date of Patent: Nov. 2, 2004

(54) PIPE MEMBER HAVING AN INFEED POINT FOR AN ADDITIVE

(75) Inventors: Markus Fleischli, Winterthur (CH); Peter Mathys, Neuhausen (CH); Albert Breiter, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 65 days.

(21) Appl. No.: 10/268,634

(22) Filed: Oct. 9, 2002

(65) Prior Publication Data

US 2003/0072214 A1 Apr. 17, 2003

(30) Foreign Application Priority Data

Oct. 16, 2001 (EP) ..... 01811015

(51) Int. Cl.[7] ..... B01F 5/06; B01F 15/02
(52) U.S. Cl. ..... 366/174.1; 366/337
(58) Field of Search ..... 366/176.1, 167.1, 366/336, 337

(56) References Cited

U.S. PATENT DOCUMENTS 3,751,009 A * 8/1973 Archer ..... 366/337
4,019,719 A * 4/1977 Schuster et al. ..... 366/338
4,758,098 A 7/1988 Meyer
4,919,541 A * 4/1990 Grosz-Roell et al. ..... 366/337
4,929,088 A * 5/1990 Smith ..... 366/337
4,981,368 A * 1/1991 Smith ..... 366/337
5,330,267 A * 7/1994 Tauscher ..... 366/336
5,456,833 A * 10/1995 Butcher et al. ..... 210/488
5,839,828 A 11/1998 Glanville
6,595,682 B2 * 7/2003 Mathys et al. ..... 366/337

FOREIGN PATENT DOCUMENTS

EP 1 153 650 A1 11/2001

* cited by examiner

*Primary Examiner*—Tony G. Soohoo
(74) *Attorney, Agent, or Firm*—Townsend and Townsend and Crew LLP

(57) ABSTRACT

The pipe member (1) having an infeed point (2) for an additive (20) includes a pipe wall (11) and a static mixing element (12). The infeed points are provided for introducing the additives into a flowing, low viscosity fluid (10). The static mixing element consists of a pair of vanes (5*a*, 5) and of a third vane (6). The vane pair (5), which forms a restriction deflecting the flow (10') of the fluid, is formed with substantially mirror symmetry with respect to a central plane (15) extending in the direction of the flow. The third vane is arranged in a crossing manner with respect to the vane pair and in a lying manner in the region of the central plane. It has a rear side (60) with respect to the flow which extends from a base at the pipe wall to a downstream end. Each infeed point is arranged at the rear side of the third vane.

15 Claims, 3 Drawing Sheets

PIPE MEMBER HAVING AN INFEED POINT FOR AN ADDITIVE

BACKGROUND OF THE INVENTION

The invention relates to a pipe member having an infeed point for an additive or having a plurality of such infeed points and having a static mixing element. The invention also relates to a conduit with the pipe member of the invention and to uses of the pipe member. The additives are mixed into a flowing low viscosity fluid by means of the static mixing element. The static mixing element consists of a pair of vanes and a third vane which is arranged cross-wise with respect to the vane pair. In this respect, a vane is understood to be a plate-like body which is flat or which can also be lightly curved, which has an elongate design and which extends between a base and a narrow end.

The pipe member in accordance with the invention can in particular be a ring which can be clamped between flanges of conduit parts disposed upstream and downstream. Such an intermediate flange ring for the additional dosing and mixing of an additive (or of a plurality of additives) into a fluid stream is known, for example, from U.S. Pat. No. 5,839,828. The additive is fed into the inner space of the ring via connections and is there mixed into the fluid stream under the influence of a diaphragm which induces a vortex. For an improvement of the mixing quality, it has been proposed (European application No. 01810359.8—not pre-published) to use instead of the diaphragm, which has a particular symmetry, a mixing element with crossing vanes, the mixing element not having the symmetry present in the diaphragm. Furthermore, the improved device should be made in the form of a ring dosing device in which the mixing in of the additive is carried out while using a plurality of spot-wise infeed points, with these infeed points being positioned at an annular passage around the mixing element.

SUMMARY OF THE INVENTION

It is an object of the invention to provide a pipe member for mixing in one or more additives into a flowing low viscosity fluid, with the pipe member including a mixing element with crossing vanes and with the additive feed taking place in a manner which is simpler to carry out than with the annular dosing device and without compromises in the mixing quality.

The pipe member having an infeed point for an additive or having a plurality of such infeed points includes a pipe wall and a static mixing element. The infeed points are provided for introducing the additives into a flowing low viscosity fluid. The static mixing element consists of a pair of vanes and a third vane. The vane pair, which forms a restriction deflecting the flow of the fluid, is formed with substantially mirror symmetry with respect to a central plane extending in the direction of the flow. The third vane is arranged in a crossing manner with respect to the vane pair and in a lying manner in the region of the central plane. It has a rear side with respect to the flow which extends from a base at the pipe wall to a downstream end. Each infeed point is arranged at the rear side of the third vane.

In accordance with the invention, the infeed point is arranged at the rear side of the third vane. It has surprisingly been found that with such an arrangement, which is very simple in design thanks to a single infeed point, a mixing quality results which is substantially better than expected. This mixing quality is better than with the annular dosing device of more complex designs in which the additive—in the expectation of a better mixing quality—is fed into the mixing space through an annular passage and a plurality of nozzle passages, with the same mixing element being installed in this mixing space as in the more favorable arrangement.

The invention will be described in the following with reference to the drawings.

DESCRIPTION OF THE PREFERRED EMBODIMENTS

Figure 1:
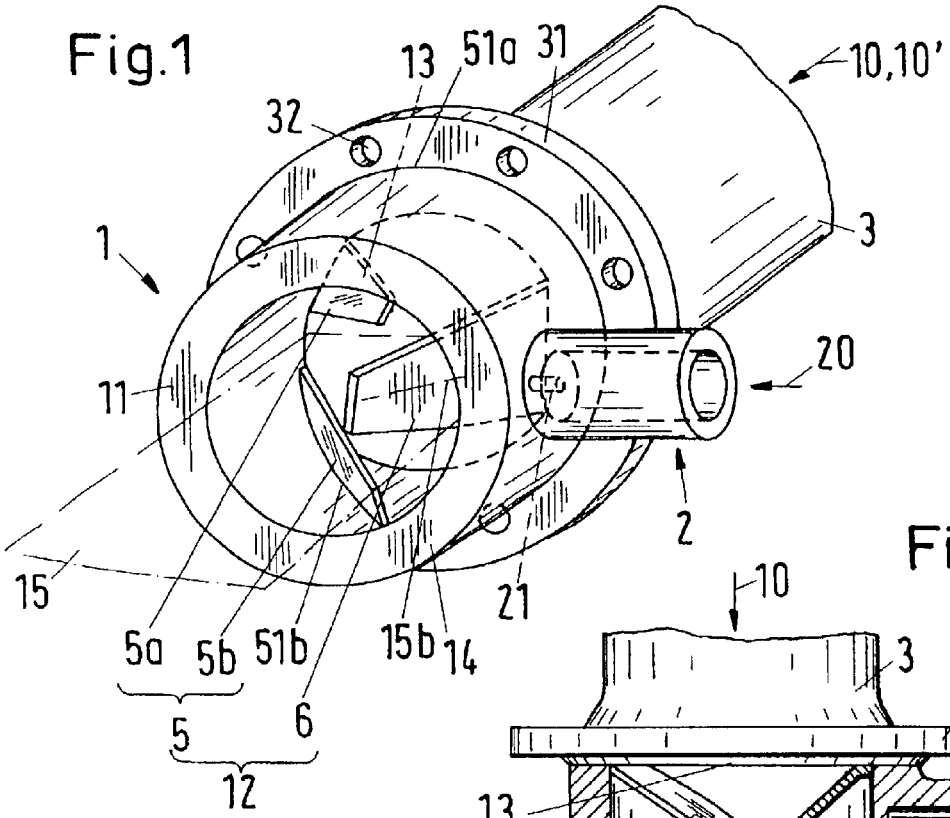
FIG. 1 shows a pipe member in accordance with the invention.
Figure 2:
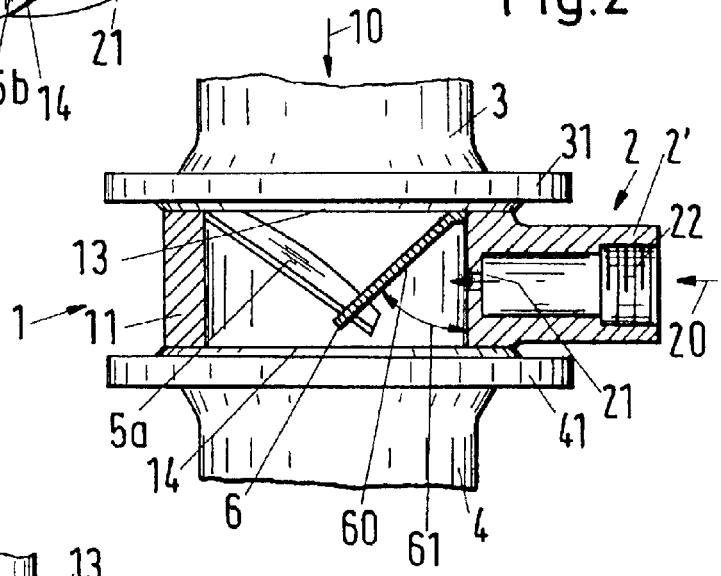
FIG. 2 is a cross-section through the pipe member of FIG. 1.

FIGS. 1 and 2 represent a pipe member 1 in accordance with the invention having an infeed point 2 for an additive 20. A cylindrical pipe wall 11 has an inlet side 13 for a connection to an upstream conduit 3 and an outlet side 14 for a connection to a downstream conduit 4. The flow 10' of a low viscosity fluid 10 leads through the inner space of the pipe member 1. The additive 20 is mixed into the fluid 10 by a static mixing element 12 which is arranged downstream of the inlet side 13. The mixing element 12 consists of a vane pair 5 with vanes 5*a*, 5*b* and a third vane 6. The vane pair 5, which forms a diaphragm deflecting the flow 10' of the fluid 10, is formed with substantially mirror symmetry with respect to a central plane 15 extending in the direction of the flow 10'. The third vane 6 is located in the region of the central plane 15, through which it is cut along the chain-dotted line 156. The third vane 6 is arranged in a crossing manner with respect to the vane pair 5. It has a rear side 60 with respect to the flow 10' which extends from a base at the pipe wall 11 to a downstream end and thereby forms an angle in the central plane 15 from 30° to 60°. In accordance with the invention, the infeed point 2 is arranged at the rear side of the third vane 6. The angle 61 preferably has a value from 40° to 50°.

The infeed point 2 includes a connection 2' and a nozzle passage 21 which leads through the pipe wall 11 and which is in particular a bore. An inner thread 22 is provided in the embodiment of FIG. 2 for a connection to a line through which the additive 20 can be delivered. The pipe wall 11 having the inlet side 13 and the outlet side 14 is made as an intermediate flange member. The intermediate flange member 11 can be clamped between a flange 31 of the upstream conduit 3 and a flange 41 of a downstream conduit 4. The two flanges 31 and 41 can be connected and clamped together by means of screws (not shown) inserted into bores 32.

Figure 7:
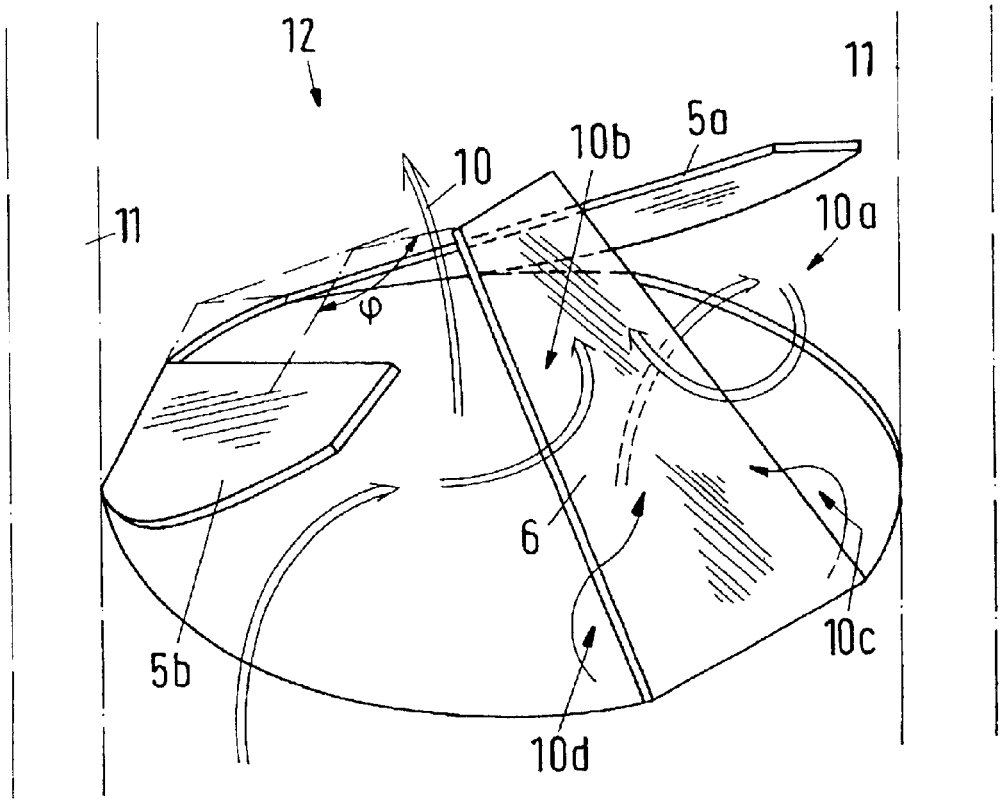
FIG. 7 is a representation of the flow relationships in the static mixer of the pipe member in accordance with the invention.

The vanes 5*a*, 5*b* of the pair 5 lie on two planes which intersect at least approximately in the central plane 15 under a shallow angle (ϕ, see FIG. 7). The vanes 5*a*, 5*b* preferably lie at peripheral edges 51*a* and 51*b* respectively without gaps to the pipe wall 11; they can be connected to the pipe wall 11.

The pipe wall 11 is represented by a shape in which the pipe cross-section is circular. This can, however, also have other shapes.

Figure 3:
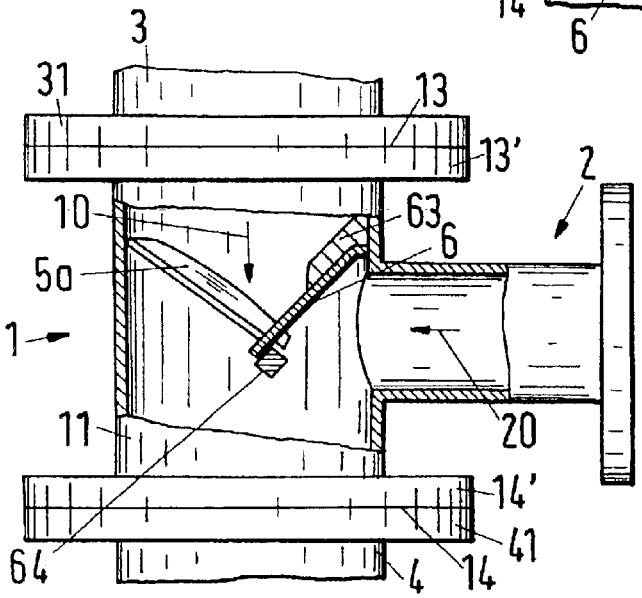
FIG. 3 shows a second embodiment of the pipe member.

FIG. 3 shows a second embodiment of the pipe member 1. The inlet side 13 is made as a flange 13' at the inlet side; a second flange 14' is arranged at the outlet side and can be connected to the downstream conduit 4 via a flange 41. This embodiment is suitable for large additive amounts. The infeed point 2 is a pipe with a relatively large diameter which opens into the inner space of the pipe wall 11 without a restriction. The third vane 6 can be stiffened by means of a reinforcement rib 63. The three vanes 5*a*, 6, 5*b* (5*b* not visible) can be connected to a transverse carrier 64 for a further reinforcement at the vane ends. A vibration of the vanes is prevented by this reinforcement. The flange 13' at the inlet side or the flange 14' at the outlet side can also be omitted.

Figure 4:
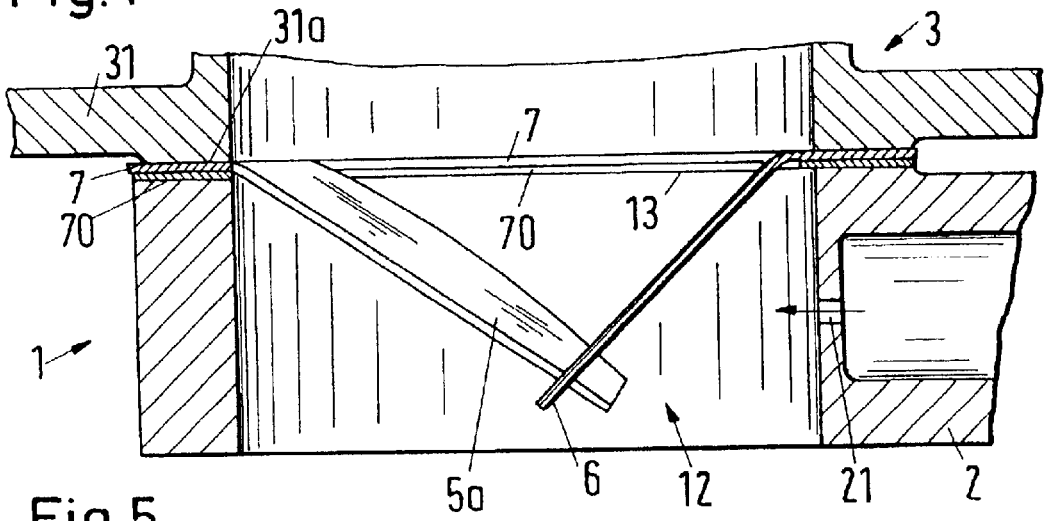
FIG. 4 shows a pipe member having a specially designed mixing element.

FIG. 4 shows a pipe member 1 having an especially designed mixing element 12. The vanes 5*a*, 6 and 5*b* are secured to a shallow ring 7 or connected to such a ring. This ring 7 is tightly inserted between the flange 31 of the conduit 3 and the inlet side 13, preferably with seals 70 (only one shown). The ring 7 can also be inserted into a groove (not shown), with this groove forming a shallow recess at the end face 31*a* of the flange 31.

A conduit, into which the pipe member 1 in accordance with the invention is installed, includes parts 3 and 4 which are disposed upstream and downstream of the installed pipe member 1. These parts 3 and 4 have the same or largely the same inner diameter D as the installed pipe member 1.

Figure 5:
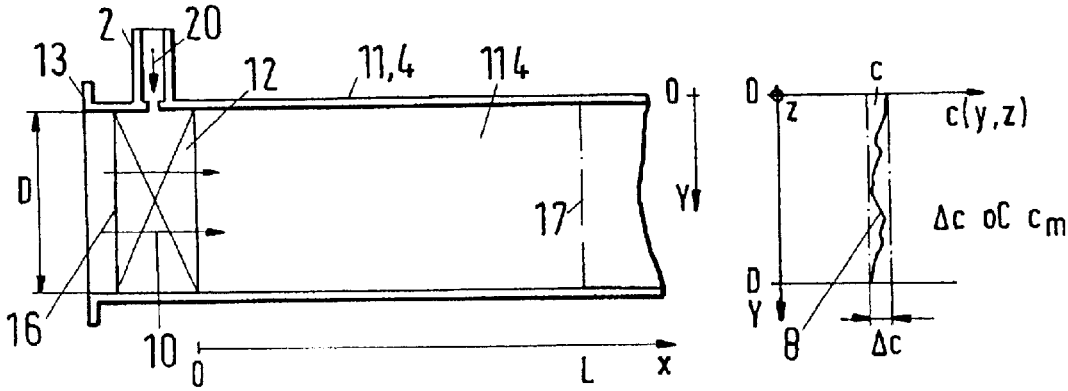
FIG. 5 is a schematic representation for the explanation of measurements.
Figure 6:
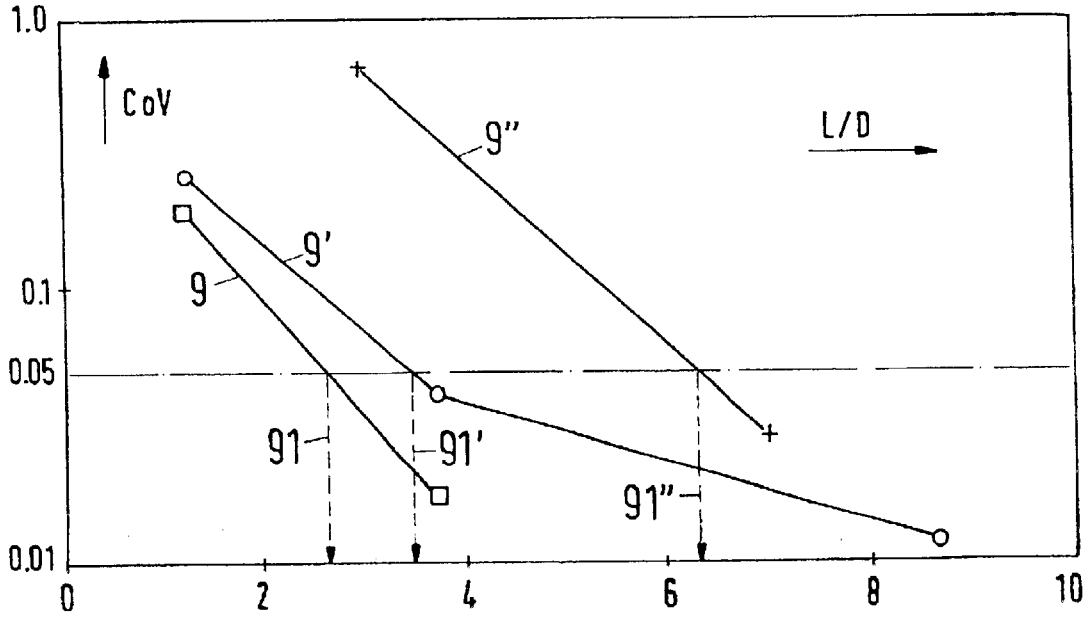
FIG. 6 is a diagram with measurement results.

Some parameters are explained with respect to the measuring results shown in FIG. 6 with reference to a schematic representation which is shown in FIG. 5: The pipe wall 11, alone or together with a part of the downstream conduit 4, includes a pipe length 114 whose start 16 lies at x=0 (outlet side of the static mixing element 12) and whose end 17 lies at x=L (length of the pipe length 114). For a predetermined homogeneity of an additive distribution 8, the quotient L/D (D=pipe inner diameter) must adopt a value which depends on the mixing effect of the device including the mixing element 12 and the infeed point 2. The additive distribution 8—see the diagram on the right-hand side in FIG. 5—can be represented for every path coordinate x by a concentration c(y, z) (where the coordinates x, y and z form an orthogonal system). This concentration varies by a mean value $c_m$ in the region of an interval of the width Δc. The larger x is, the smaller Δc is due to the effect of the static mixer. A distribution coefficient CoV, which can be determined experimentally, is a measure for the ratio $\Delta c/C_m$: (where CoV=standard deviation divided by $c_m$: $CoV^2=\Sigma(c_i/c_m-1)^2/(n-1)$ for n measured values $c_i1=1 \ldots n$). If this coefficient CoV is equal to 0.05, then the additive distribution for most applications can be termed sufficiently homogeneous.

The diagram of FIG. 6 shows measured results for three static mixers, with a mixing ratio of 1:2000 (0.05%) having been selected: The two points at the ends of the length 9 (squares) are measured values for the pipe member 1 in accordance with the invention. The arrow 91 points to the position L/D at which a homogeneous additive distribution is reached: L/D there amounts to approximately 2.5. Corresponding measured values (circles) on the length extent 9' have been obtained for an annular dosing device with sixteen infeed points. Here, L/D is approximately equal to 3.5 (arrow 91'), that is, much larger. The measured values (crosses) of the length 9" have been found for another mixing element which has a very simple shape and which is described in EP-A-800 857. It was expected for this mixing element that the mixing effect is likewise relatively good. However, here the required mixing length 4 has proved to be substantially longer (see arrow 91"). Further measurements for the pipe member 1 in accordance with the invention with different mixing ratios have led to largely the same results. For example, for the mixing ratio of 1:5 (20%), a mixing length L, which is a little shorter, resulted. Interestingly, pronounced dependencies on the mixing ratio resulted for the other, known mixing devices. The corresponding mixing length, however, was always much shorter for the device in accordance with the invention.

It can thus be stated that the pipe member 1 in accordance with the invention, which has a very simple design construction, has an unexpectedly good mixing effect, and indeed unexpectedly good with respect to other mixers for which good mixing effects had also been expected.

The pipe member in accordance with the invention is suitable to mix a fluid low viscosity additive 20 into a main flow 10'. The additive flow is as a rule not larger than the main flow. Mixing ratios which can be practically as small as desired (e.g. 1:10,000) can also be made. The diameter of the infeed point must be adapted in each case.

In FIG. 7, the flow ratios are shown in the static mixing element 12 of the pipe member 1 in accordance with the invention (wall 11) as resulted from flow calculations: The inflowing fluid 10 is partly deflected to the third vane 6 by the wing pair 5. The fluid 10 passing through the restriction of the vane pair 5 forms two counter-rotating vortices 10*a* and 10*b* at the leeward sides of the vanes 5*a*, 5*b* and 6. Small vortices 10*c* and 10*d*, which ebb away rapidly, additionally arise at the base of the third vane. The experimentally confirmed, excellent mixing effect results due to these flow ratios which are induced by the static mixing element. The vane pair 5 forms a shallow angle ϕ which is smaller than 180° and which has an advantageous effect on the formation of the vortices 10*a* and 10*b*.

Figure 8:
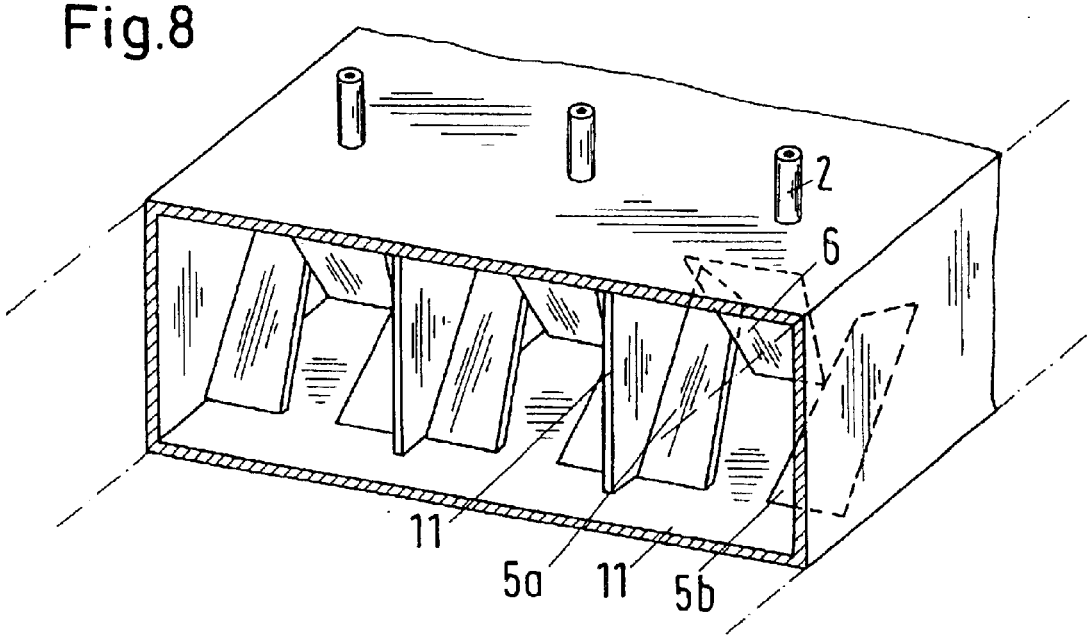
FIG. 8 shows a device in which three pipe members in accordance with the invention are arranged in parallel.

FIG. 8 shows a device in which three pipe members 1 of the invention, which have rectangular cross-sections, are arranged in parallel in a common passage.

What is claimed is:

1. A pipe member for introducing an additive into a low viscosity fluid flow comprising a pipe wall, a static mixing element including a pair of vanes and a third vane, the pair of vanes forming a restriction deflecting the fluid flow and being arranged in substantial mirror symmetry with respect to a central plane extending in a direction of the fluid flow, the third vane being arranged in a crossing manner with respect to the pair of vanes and in a region of the central plane, the third vane having a rear side with respect to the fluid flow which extends from a base at the pipe wall to a downstream end and forming an angle relative to the central plane, and one infeed point for the additive arranged at the rear side of the third vane.

2. A pipe member in accordance with claim 1 wherein the infeed point includes a connection and at least one nozzle passage leading through the pipe wall.

3. A pipe member in accordance with claim 2 wherein the nozzle passage comprises a bore.

4. A pipe-member in accordance with claim 1 wherein the angle of the third vane has a value between 30° and 60°.

5. A pipe member in accordance with claim 4 wherein the vanes of the static mixer element are connected to a shallow ring inserted between a flange of the upstream conduit and the inlet side.

6. A pipe member in accordance with claim 4 wherein the angle of the third vane has a value between 40° and 50°.

7. A pipe member in accordance with claim 1 including an inlet side for a connection to an upstream conduit and an outlet side for a connection to a downstream conduit.

8. A pipe member in accordance with claim 7 including at least one of a flange on the inlet side and a flange on the outlet side.

9. A pipe member in accordance with claim 7 wherein the pipe wall comprises an intermediate flange member clamped between the flanges of the upstream conduit and the downstream conduit that are connected by means of screws.

10. A pipe member in accordance with claim 9 wherein the flange member comprises a ring cylinder.

11. A pipe member in accordance with claim 1 wherein the vanes of the pair of vanes are arranged in two planes which intersect at least approximately at a shallow angle in the central plane; and wherein the vanes contact the pipe wall with peripheral edges without gaps.

12. A pipe member in accordance with claim 11 wherein the peripheral edges of the vanes are connected to the pipe wall.

13. A conduit having a pipe member in accordance with claim 1 including a pipe having a length downstream of the mixing element which is larger than the inner diameter of the pipe member by a factor of 1 to 5.

14. A conduit according to claim 13 wherein the pipe length is larger than the inner diameter of the pipe member by a factor of 2 to 3.

15. A method for introducing an additive into a low viscosity fluid flow through a pipe member having a pipe wall comprising mixing the low viscosity fluid with the additive by positioning a pair of vanes and a third vane in the fluid flow, arranging the pair of vanes in substantial mirror symmetry with respect to a central plane extending in a direction of the fluid flow so that the pair of vanes form a restriction deflecting the fluid flow, arranging the third vane in a crossing manner with respect to the pair of vanes in a region of the central plane, the third vane having a rear side with respect to the fluid flow, positioning the third vane so that a base thereof is located at the pipe wall and a downstream end of the third vane forms an angle relative to the central plane, and injecting the additive into the fluid flow from a single infeed point at the rear side of the third vane.

* * * * *